United States Patent [19]

Northcote

[11] 4,455,968

[45] Jun. 26, 1984

[54] BOILERS

[75] Inventor: Reginald D. Northcote, Lower Penn, England

[73] Assignee: Thorn Emi Energy Developments, Limited, West Midlands, England

[21] Appl. No.: 409,897

[22] Filed: Aug. 20, 1982

[51] Int. Cl.[3] ..... F22B 7/12; F23H 11/10

[52] U.S. Cl. ..... 122/4 D; 122/149; 110/204

[58] Field of Search ..... 122/4 D, 49, 22, 149, 122/2; 110/245, 261, 262, 204

[56] References Cited

U.S. PATENT DOCUMENTS

| | | | |
|---|---|---|---|
| 3,638,621 | 2/1972 | Craig | 122/149 |
| 4,002,148 | 1/1977 | Harding | 122/149 |
| 4,080,931 | 3/1978 | Northcote | 122/149 |
| 4,080,932 | 3/1978 | Northcote | 110/204 |
| 4,162,686 | 7/1979 | Infield et al. | 122/149 |
| 4,184,456 | 1/1980 | Taylor et al. | 122/4 D |
| 4,260,369 | 4/1981 | Warshawsky | 432/106 |
| 4,276,020 | 6/1981 | Shibuya et al. | 432/106 |
| 4,296,712 | 10/1981 | Vogt | 122/149 |
| 4,312,919 | 1/1982 | Devanney | 122/4 D |
| 4,349,969 | 9/1982 | Stewart et al. | 122/4 D |

FOREIGN PATENT DOCUMENTS

| | | |
|---|---|---|
| 952404 | 3/1964 | United Kingdom . |
| 1410166 | 10/1975 | United Kingdom . |

*Primary Examiner*—Henry C. Yuen

*Attorney, Agent, or Firm*—Lowe, King, Price & Becker

[57] ABSTRACT

A shell boiler is disclosed having apparatus for feeding solid fuel to a furnace grate, contained within a furnace tube of the boiler, downwardly through the steam and/or water space of the boiler. The apparatus for feeding solid fuel to the furnace grate comprises a device for classifying and separating fine particles of fuel, having a particle size below a predetermined size, from the remainder of the fuel and feeding the fine particles into the furnace tube at a different location to that at which the remainder of the fuel is introduced into the furnace tube. The fine particles may be fed through a grit arrestor and fed into the furnace tube along with the grit separated by the grit arrestor.

9 Claims, 3 Drawing Figures

BOILERS

BACKGROUND OF THE INVENTION

1. Field of the Invention

This invention relates to a shell boiler of the type comprising an outer continuous shell within which is contained the steam and/or water space of the boiler, a furnace tube containing a furnace grate, and a plurality of smoke tubes for passage therethrough of products of combustion of the furnace, the boiler having apparatus for feeding solid fuel to the furnace grate downwardly through the steam and/or water space of the boiler.

2. Summary of the Invention

An object of the present invention is to provide a new and improved boiler of the type described.

According to the present invention, we provide a boiler of the kind specified wherein the apparatus for feeding solid fuel to the furnace grate comprises a means for classifying and separating fine particles of fuel having a particle size below a predetermined size, from the remainder of the fuel and feeding the fine particles into the furnace tube at a different location to that at which the remainder of the fuel is introduced into the furnace tube.

The boiler may be provided with a grit arrestor arranged to extract grit entrained in the products of combustion of the boiler and means to feed the extracted grit into the furnace tube, and wherein said fine particles of fuel are fed into the furnace tube with the extracted grit.

The grit arrestor may be located at a rear end of the boiler and fine particles may be fed thereto and both fine particles and the extracted grit fed from the grit arrestor into the furnace tube.

The fine particles, or fine particles and extracted grit, may be introduced into the furnace tube in a direction at any angle from a right angle to 180° to the horizontal vector of the direction of flow of the products of combustion from the furnace tube.

The fuel feed means may comprise a first conduit extending downwardly from the fuel classifying and separating means through the roof of the furnace tube, pneumatic transport means to provide a flow of transportair to feed fuel along a second conduit to the fuel classifying and separating device and a third conduit extending from the fuel classifying and separating device to a fines-air separating means for separating the fine particles from the transport air.

When the furnace is provided with a grit arrestor, the fines-air separating means may be connected thereto so that the fines are fed to the grit arrestor while the transport air is fed to the intake side of a fan which provides said transport air for the fuel.

The fine particles or fine particles and grit may be fed into the furnace tube by a second pneumatic transport means the transport air of which is provided by a main combustion air fan of the boiler.

The grit arrestor may be provided with a venturi device so that said second transport air withdraws grit and fine particles from the grit arrestor by venturi action and transports them to the furnace tube.

BRIEF DESCRIPTION OF THE DRAWINGS

The invention will now be described in more detail by way of example, with reference to the accompanying drawings, wherein.

DESCRIPTION OF THE PREFERRED EMBODIMENTS

Figure 1:
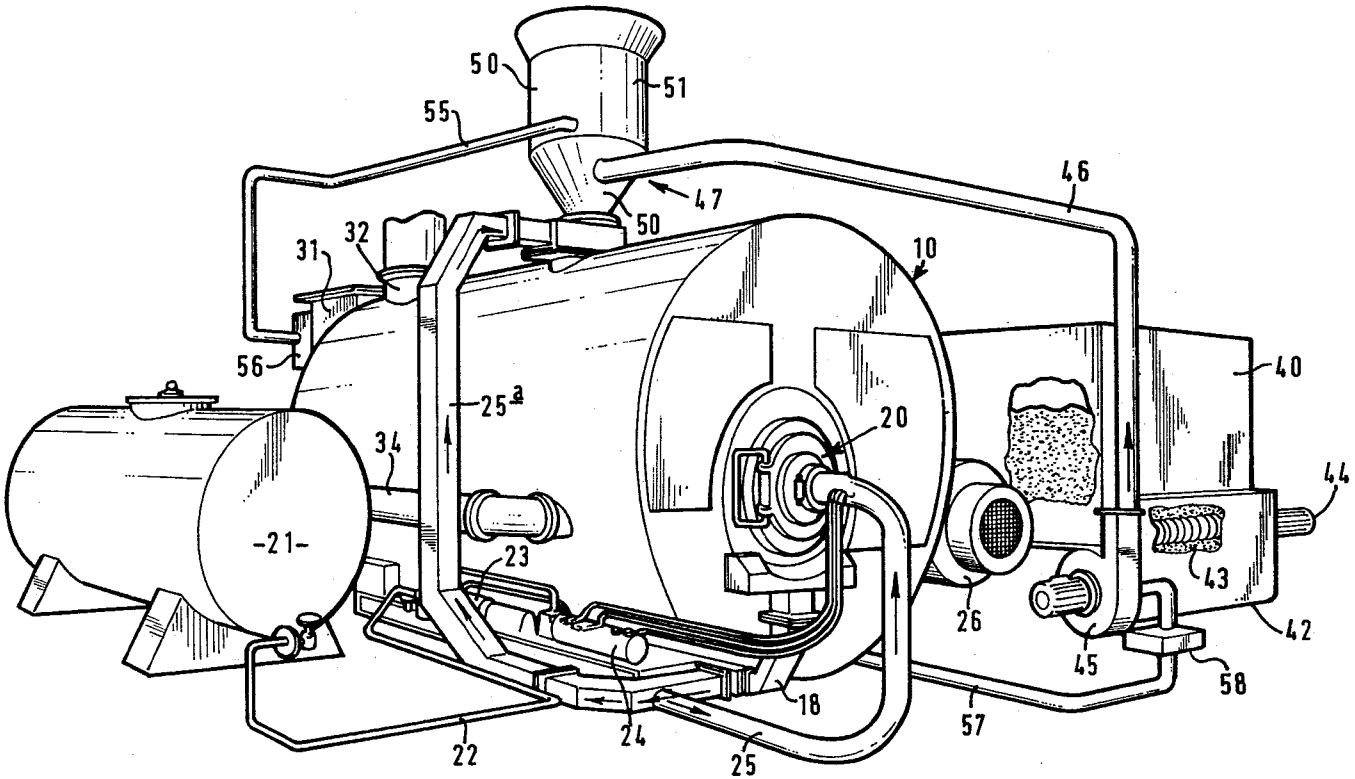
FIG. 1 is a perspective view, partly broken away, of a boiler embodying the invention.
Figure 2:
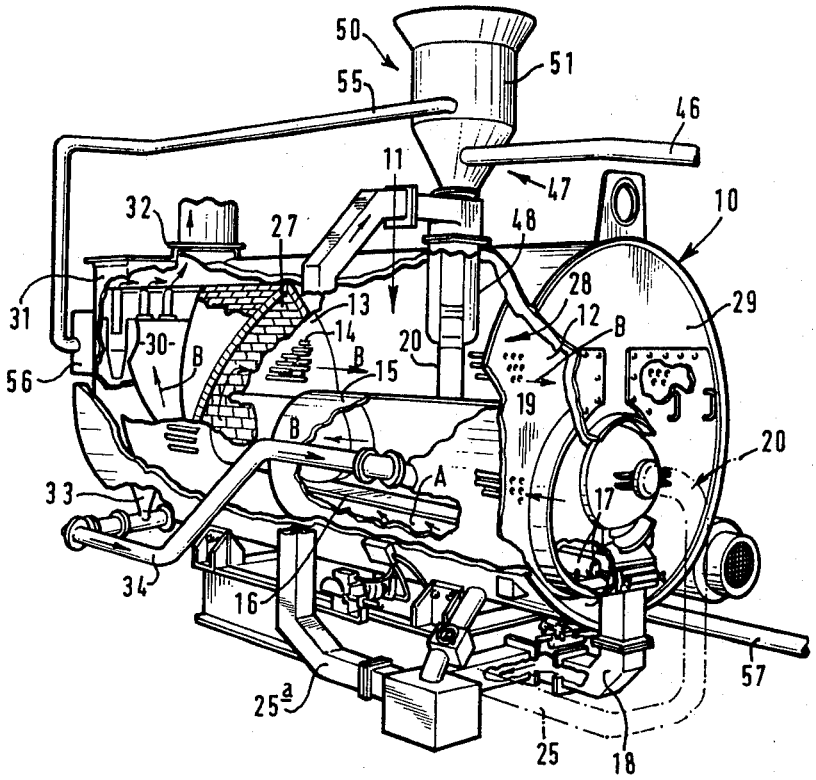
FIG. 2 is another perspective view, partly broken away, of part of the boiler of FIG. 1.
Figure 3:
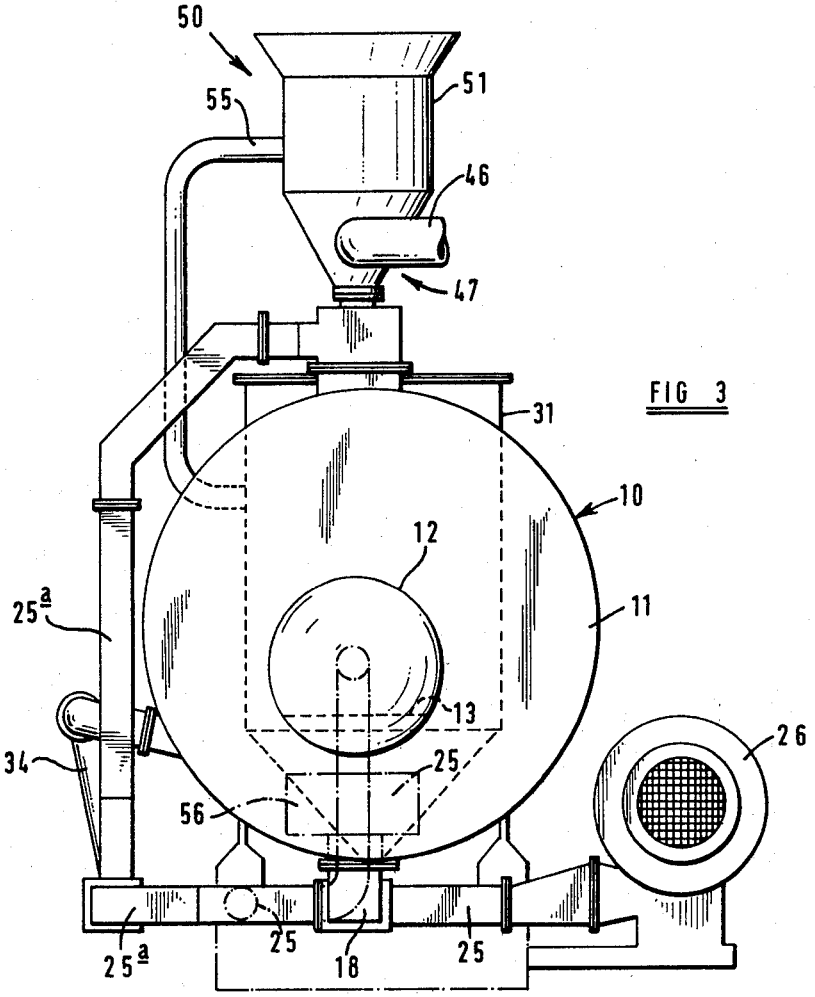
FIG. 3 is a front elevation of the boiler of FIG. 1.

Referring to the drawing a shell boiler comprises an enveloping shell 10, the majority of which encloses a steam drum or water space 11. Positioned within shell 10 are tube plates 12, 13 between which extend a plurality of smoke tubes 14 as well as a cylindrical combustion or furnace tube 15. Positioned within combustion tube 15 is a grate 16 to the underside of which is fed primary air through tubes 17 and a duct 18 as shown by arrows A.

The furnace illustrated in the drawing is a multifuel furnace and accordingly the combustion chamber or furnace tube 15 is provided at front end 19 with an oil burner 20 to which oil is fed under pressure from an oil tank 21 through a line 22 containing a pump 23 and an electrical pre-heater 24.

A burner air supply duct 25 extends from a fan or blower 26 and is arranged to feed burner air into the combustion tube 15 along a horizontal axis coincident with axis of the oil burner 20. Primary air duct 18 branches from burner air supply duct 25.

Between the rear end wall of shell 10 and tube plate 13 is provided a first smoke box 27 so that combustion products from furnace tube 15 pass, as shown by the arrows B, into the smoke box and then through a first series of smoke tubes 14 arranged parallel to the axis of the furnace tube to a second smoke box 28 provided between tube plate 12 and front end wall 29 of the shell. The products of combustion then pass through a further series of smoke tubes 14 to a chamber 30 at the rear of the boiler. Chamber 30 contains a grit arrestor 31 for separating grit from the combustion products which then pass through a flue 32 and hence into a chimney (not shown).

The grit from grit arrestor 31 passes through a conduit into a venturi neck 33 provided in a conduit 34, which extends from blower 26 to furnace tube 15 at a position adjacent the front end thereof, so that a venturi action provides suction to draw grit from arrestor 31 into conduit 34 and so that the grit is introduced into the furnace tube at a position adjacent the front of the furnace which is a quiescent zone. If desired, the grit may be introduced at another location. It is preferred that the grit be introduced into tube 15 at an angle between a right angle and 180° to the longitudinal axis of the furnace tube and hence to the horizontal vector of the flow direction of combustion products from the furnace tube.

Solid fuel such as coal is contained within a hopper 40. At base of the hopper 40 is located a screw conveyor 43 driven by a motor. Conveyor 43 is arranged to deliver fuel to a feed pipe 46 leading from a pneumatic blower 45 to a feeding apparatus 47 so that the fuel is fed pneumatically to the feeding apparatus, i.e. the fuel is carried along by a flow of transport air provided by the blower.

Apparatus 47 includes a first conduit 48 which extends vertically downward through shell 10 and water space 11 and passes through the roof of furnace tube 15. Suitable means (not shown) are provided to distribute fuel evenly over the grate 16. Secondary combustion air, supplied through a branch 25*a* of duct 25, is fed into furnace tube 15 through passageways associated with conduit 48.

The apparatus 47 also includes a classifying and separating means 50 which separates fine particles of fuel below a predetermined size from the remainder of the fuel.

The classifying and separating means 50 comprises a chamber 51 which extends vertically upward and is of such internal configuration so as to provide a low pressure area in which the velocity of the air is reduced. Thus only fine particles of fuel, of approximately 2 mm and lessin size, will be carried upwardly and hence will be separated from the remainder of the fuel.

The separated fine particles and the transport air are fed via a third conduit 55 to a fines-air separating means 56 mounted on main grit arrestor 31 while the remainder of the fuel is fed into the furnace tube 15 via the conduit 48.

The fines-air separating means 56 feeds the separated fine particles into main grit arrestor 31 while the transport air is fed via a conduit 57 to the intake of the fan 45. A restricting throat is provided in the conduit 57, of a suitable size to provide the necessary degree of pressure upstream of the throat. A throat of the necessary size is introduced into the conduit 57 during assembly/commissioning of the boiler and does not thereafter have to be changed.

In addition, a damper controlled additional air feed 58 is provided whereby additional air is fed to the intake of the fan 45 to replace air lost in the fuel feed circuit, such as that escaping into the hopper 40 through the screw conveyor 43. In practice approximately 5% of the air leaving blower 45 is lost and hence approximately 5% needs to be added through additional air feed means 58.

The separated fine particles are fed into the furnace tube 15 with the grit from the grit arrestor 31 as described hereinbefore.

Although the separated fine particles are fed into the furnace tube 15 by virtue of being fed to the grit arrestor 31, if desired they may be fed separately to the furnace tube 15.

I claim:

1. A boiler comprising an outer continuous shell within which is contained a steam or water space of the boiler; a furnace tube, containing a furnace grate, and a plurality of smoke tubes for passage of products of combustion of the furnace through the steam or water space, said boiler having an apparatus for feeding solid fuel to the furnace, said apparatus including a classifying and separating device; means to provide a flow of transport air to feed fuel along a feed conduit to the fuel classifying and separating device, said fuel classifying and separating device including a chamber being of a predetermined internal configuration to provide a low pressure area in which velocity of transport air carrying fuel through the feed conduit is reduced in the chamber so that coal dust and larger fine particles of predetermined size are carried upwardly through the chamber and separated from the remainder of the fuel; a further conduit extending downwardly from said chamber to the furnace to allow said remainder of the fuel to enter the furnace; and means for drawing off fine particles, when separated, and introducing them into the furnace tube in a direction at an angle from approximately 90° to 180° to the horizontal vector of the direction of flow of the products of combustion from the furnace tube.

2. A boiler according to claim 1 wherein the fine particles are fed into the furnace tube by a pneumatic transport means.

3. A boiler according to claim 1 wherein the boiler is provided with a grit arrestor arranged to extract grit entrained in the products of combustion of the boiler and means to feed the extracted grit into the furnace tube, and wherein said fine particles of fuel are fed into the furnace tube with the extracted grit.

4. A boiler according to claim 3 wherein said fine particles are fed to the grit arrestor and both said fine particles and the extracted grit are fed from the grit arrestor into the furnace tube.

5. A boiler according to claim 4 wherein the grit arrestor is located at a rear end of the boiler.

6. A boiler according to claim 3 wherein the fine particles and grit are fed into the furnace tube by a pneumatic transport means the transport air of which is provided by a main combustion air fan of the boiler.

7. A boiler according to claim 3 wherein the grit arrestor is provided with a venturi device so that said transport air provided by the main combustion air fan withdraws grit and fine particles from the grit arrestor by venturi action and transports them to the furnace tube.

8. The boiler according to claim 1, wherein said chamber separates fine particles of up to approximately 2 mm in size from the remainder of fuel.

9. The boiler of claim 1, wherein said means for feeding fine particles into the furnace tube is a conduit connected to the classifying and separating means extending from the chamber into a region of the furnace tube located above fuel deposited on the grate.

* * * * *